US010850948B2

(12) United States Patent
Ladi et al.

(10) Patent No.: US 10,850,948 B2
(45) Date of Patent: Dec. 1, 2020

(54) ESCALATOR WITH A SENSOR FOR DETECTING SHEAVE MISALIGNMENT

(71) Applicant: Otis Elevator Company, Farmington, CT (US)

(72) Inventors: Srinivasa Rao Ladi, Telangana (IN); Serralathan Sr, Telangana (IN)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 16/555,523

(22) Filed: Aug. 29, 2019

(65) Prior Publication Data

US 2020/0079623 A1 Mar. 12, 2020

(30) Foreign Application Priority Data

Sep. 12, 2018 (IN) ..... 201811034443

(51) Int. Cl.
*B66B 25/00* (2006.01)
*B66B 23/04* (2006.01)
*B66B 29/00* (2006.01)

(52) U.S. Cl.
CPC ..... *B66B 25/006* (2013.01); *B66B 23/04* (2013.01); *B66B 29/00* (2013.01)

(58) Field of Classification Search
CPC ..... B66B 23/04; B66B 25/003; B66B 25/006; B66B 29/00; B66B 29/005
See application file for complete search history.

(56) References Cited

U.S. PATENT DOCUMENTS 3,049,213 A 8/1962 Fabula
3,568,813 A 3/1971 Schaeffer et al.
3,926,296 A 12/1975 Woodling et al.
5,645,156 A * 7/1997 Zaharia ..... B66B 23/04 198/323

(Continued)

FOREIGN PATENT DOCUMENTS

CN 102398844 A 4/2012
CN 105555699 A 5/2016

(Continued)

OTHER PUBLICATIONS

European Search Report; Application No. 19196567.2; dated Jul. 10, 2020; 8 pages.

(Continued)

*Primary Examiner* — Gene O Crawford
*Assistant Examiner* — Keith R Campbell
(74) *Attorney, Agent, or Firm* — Cantor Colburn LLP

(57) ABSTRACT

An escalator system wherein when a handrail belt is moving from rotation of a plurality of elevator sheaves: a controller receives data from a plurality of sensors, identifies from the data a first sheave of the plurality of sheaves as comprising reference alignment value for the system, determines for the plurality of sheaves a respective plurality of alignment values, compares the plurality of alignment values with the reference alignment value, and provides a predetermined response when any of the plurality of alignment values diverges from the reference alignment value by more than a predetermined amount.

20 Claims, 5 Drawing Sheets

(56) References Cited

U.S. PATENT DOCUMENTS

| | | | | |
|---|---|---|---|---|
| 5,782,333 | A * | 7/1998 | Pitts | B66B 23/20 198/336 |
| 6,886,667 | B2 | 5/2005 | Kunz et al. | |
| 7,404,477 | B1 * | 7/2008 | Toennisson | B66B 29/005 198/323 |
| 8,997,968 | B2 | 4/2015 | Braasch et al. | |
| 10,173,864 | B2 * | 1/2019 | Hu | B66B 23/20 |
| 10,302,549 | B2 * | 5/2019 | Yamada | G01N 19/02 |
| 2003/0199349 | A1 | 10/2003 | Sands et al. | |
| 2004/0226805 | A1 | 11/2004 | Lodge | |
| 2007/0000753 | A1 | 1/2007 | Hame et al. | |
| 2009/0266674 | A1 * | 10/2009 | Mueller | B66B 29/02 198/322 |
| 2011/0011700 | A1 | 1/2011 | Plathin et al. | |
| 2015/0008097 | A1 | 1/2015 | Andreoli et al. | |
| 2020/0031630 | A1 * | 1/2020 | Park | B66B 23/02 |

FOREIGN PATENT DOCUMENTS

| | | | |
|---|---|---|---|
| CN | 107226413 | A | 10/2017 |
| DE | 19617519 | A1 | 11/1997 |
| DE | 202015001558 | U1 | 8/2015 |
| EP | 2446279 | A1 | 5/2012 |
| JP | 2522089 | Y2 | 1/1997 |
| JP | H09272687 | A | 10/1997 |
| JP | 2003004486 | A | 1/2003 |

OTHER PUBLICATIONS

CN Office Action; Application No. 201910857248.2; dated Oct. 10, 2020; 7 pages.

* cited by examiner

ESCALATOR WITH A SENSOR FOR DETECTING SHEAVE MISALIGNMENT

CROSS-REFERENCE TO RELATED APPLICATIONS

This application claims the benefit of IN Application No. 201811034443 filed Sep. 12, 2018, the disclosure of which is incorporated herein by reference in its entirety.

BACKGROUND

The embodiments herein relate to escalator maintenance and more specifically to an escalator with a hall-effect sensor and magnet configured to detect sheave misalignment.

Aligning of an escalator handrail sheave may be a manually intensive and inaccurate process. In addition, aligning the sheave may adversely affect other escalator components, which may have become affected by the misaligned sheave.

In addition or as an alternative, an escalator handrail belt run-out from a drive sheave may be dangerous, and this may also increase noise and vibration of escalator operations, damage the drive system and affect the safety of escalator passengers.

SUMMARY

According to a first set of embodiments, disclosed is an escalator system comprising: a first member, a first belt, a first assembly operationally connected to the first member and the first belt, the first assembly comprising a plurality of sheaves mounted proximate the first member for driving the first belt, and a plurality of sensors for the plurality of sheaves, the plurality of sensors having a plurality of sampling elements and sensing elements, the plurality of sampling elements being disposed on the respective plurality of sheaves and the plurality of sensing elements being disposed on the first member proximate the respective plurality of sheaves, a controller communicating with the plurality of sensing elements, wherein when the first belt is moving from rotation of the plurality of sheaves the controller: receives data from the respective plurality of sensors, identifies from the data a first sheave of the plurality of sheaves as comprising a reference alignment value for the system, determines for the plurality of sheaves a respective plurality of alignment values, compares the plurality of alignment values with the reference alignment value, and provides a predetermined response when any of the plurality of alignment values diverges from the reference alignment value by more than a predetermined amount.

In addition to one or more of the above disclosed features for the first set of embodiments or as an alternate any of the plurality of alignment values diverges from the reference alignment by more than a first predetermined amount, a first predetermined response is transmitting an electronic alert to a building management system (BMS).

In addition to one or more of the above disclosed features for the first set of embodiments or as an alternate when any of the plurality of alignment values diverges from the reference alignment by more than a second predetermined amount, a second predetermined response is transmitting an electronic alert to the BMS and stopping the system, wherein the second predetermined amount is greater than the first predetermined amount.

In addition to one or more of the above disclosed features for the first set of embodiments or as an alternate the plurality of alignment values comprise a respective plurality of parallel alignment values and angular alignment values for the respective plurality of sheaves.

In addition to one or more of the above disclosed features for the first set of embodiments or as an alternate the plurality of sheaves includes one or more of a main handrail drive sheave, a tensioner for the main drive sheave, a lower idler sheave and an upper idler sheave.

In addition to one or more of the above disclosed features or as an alternate the first sheave is the main drive sheave.

In addition to one or more of the above disclosed features for the first set of embodiments or as an alternate the plurality of sensors comprise a respective plurality of hall effect sensors and the plurality of sampling elements are a respective plurality of magnets.

In addition to one or more of the above disclosed features for the first set of embodiments or as an alternate the plurality of sheaves comprise a respective plurality of hubs, and the plurality of sampling elements are disposed on the respective plurality of hubs.

In addition to one or more of the above disclosed features for the first set of embodiments or as an alternate the system comprises an escalator brake operationally controlled by the controller.

In addition to one or more of the above disclosed features for the first set of embodiments or as an alternate the first belt is a handrail belt, the first assembly is a handrail belt drive assembly, and the first member is a stationary escalator truss.

Further disclosed is a method of monitoring an operation of a first assembly of an escalator system, the system including one or more of the above disclosed features for the first set of embodiments.

According to a second set of embodiments, disclosed is an escalator system comprising: a first member, a belt, a handrail drive assembly operationally connected to the first member and the belt, the assembly comprising: a sheave mounted proximate the first member on which the first belt is driven, and a sensor mounted to the first member proximate to the sheave, the sensor sensing a relative transverse position of the belt relative to the sheave, a controller communicating with the sensor, wherein when belt is moving from rotation of the sheave the controller: receives data from the sensor, determines when the belt moves transversely relative to the sheave, compares the transverse movement with a reference value, provides a predetermined response when the transverse movement diverges from the reference value by more than a predetermined amount.

In addition to one or more of the above disclosed features for the second set of embodiments or as an alternate when the transverse movement value diverges from the reference value by more than the predetermined amount, the predetermined response is transmitting an electronic alert to a building management system (BMS).

In addition to one or more of the above disclosed features for the second set of embodiments or as an alternate when the transverse movement values diverges from the reference value by more than the predetermined amount, the predetermined response is transmitting an electronic alert to the BMS and stopping the system.

In addition to one or more of the above disclosed features for the second set of embodiments or as an alternate the transverse movement is toward and/or away from the sensor relative to the sheave.

In addition to one or more of the above disclosed features for the second set of embodiments or as an alternate the sheave is one or more of a main handrail drive sheave, a tensioner for the main drive sheave, a lower idler sheave and an upper idler sheave.

In addition to one or more of the above disclosed features for the second set of embodiments or as an alternate the sheave is the main drive sheave.

In addition to one or more of the above disclosed features for the second set of embodiments or as an alternate the sensor comprises a proximity sensor.

In addition to one or more of the above disclosed features for the second set of embodiments or as an alternate the embodiments comprise a plurality of sheaves including the sheave, each including a respective sensor mounted proximate thereto, each sensor communicating with the controller to determine whether the belt is transversely moving relative to any of the plurality of sheaves.

In addition to one or more of the above disclosed features for the second set of embodiments or as an alternate the embodiments comprise an escalator brake operationally controlled by the controller.

In addition to one or more of the above disclosed features for the second set of embodiments or as an alternate the first belt is a handrail belt, the first assembly is a handrail belt drive assembly, and the first member is a stationary escalator truss.

Further disclosed is method of monitoring an operation of a first assembly of an escalator system, the escalator system comprising one or more features disclosed for the second set of embodiments.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited in the accompanying figures in which like reference numerals indicate similar elements.

DETAILED DESCRIPTION

The system disclosed herein comprises a conveyance system that moves passengers between floors and/or along a single floor. Such conveyance systems may include escalators, people movers, etc.

Figure 1:
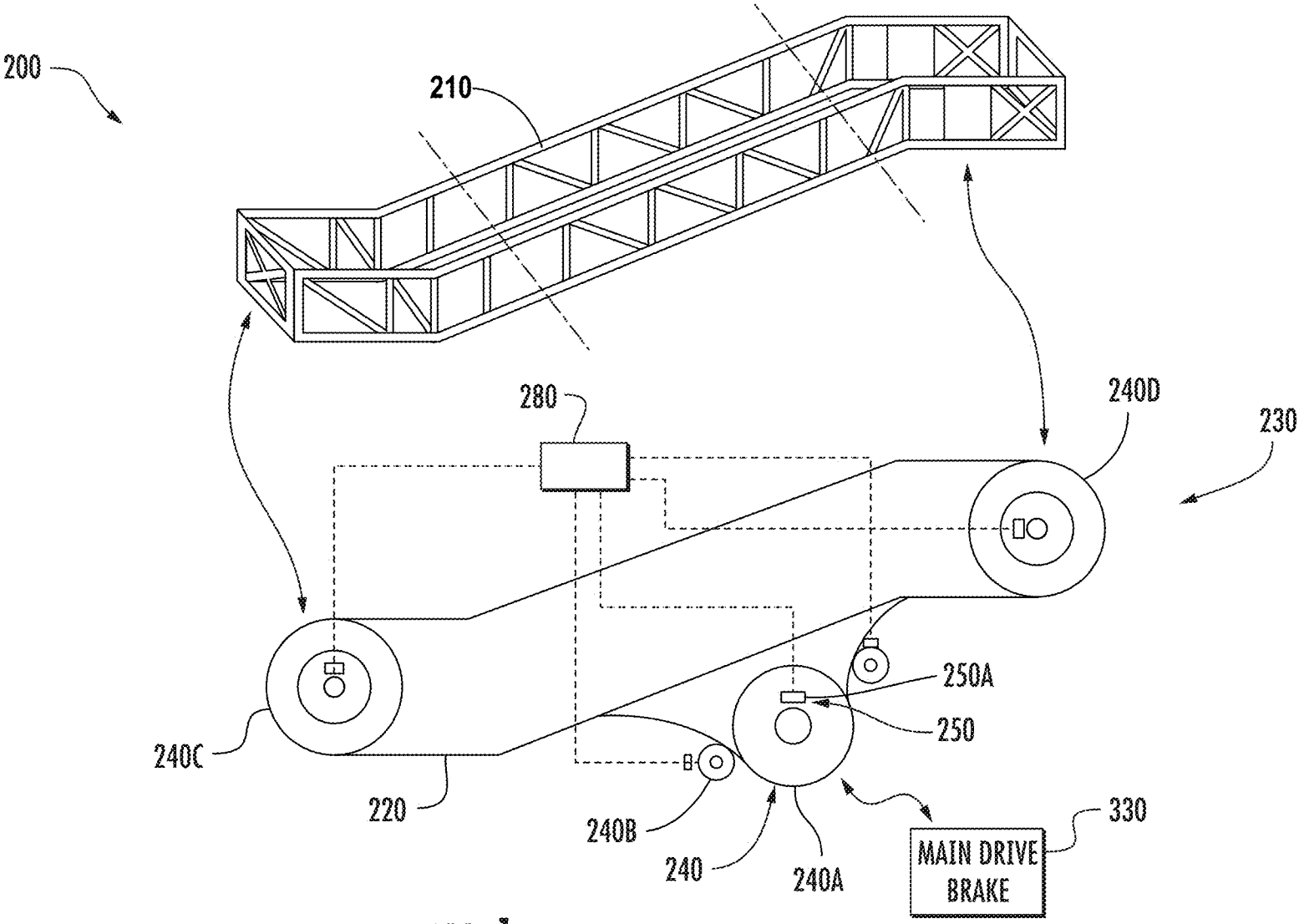
FIG. 1 is a schematic illustration of an escalator system that may employ various embodiments of the present disclosure.

Turning to FIG. 1, disclosed is an escalator system 200. The system 200 may comprise a first member 210, which is a first stationary member. The system 200 may further comprise a first belt 220, which is a handrail belt, and a first assembly 230, which may be handrail belt drive assembly. The first assembly 230 may be operationally connected to the first member 210 and the first belt 220. The first assembly 230 may comprise a plurality of sheaves referenced generally as 240, including first sheave 240A. The plurality of sheaves 240 may be mounted proximate the first member 210 for driving the first belt 220. Accompanying the plurality of sheaves 240 may be a respective plurality of sensors referenced generally as 250, including first sensor 250A.

Figure 2:
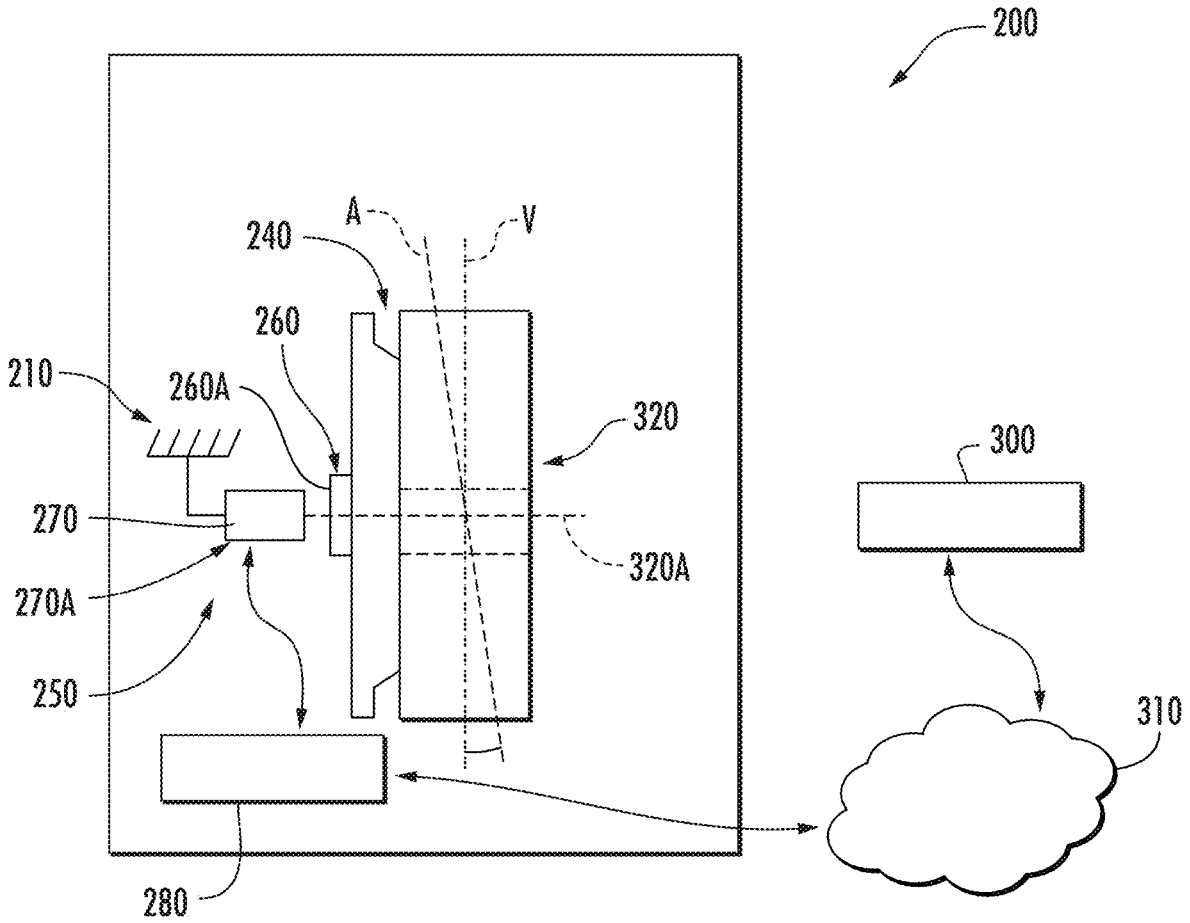
FIG. 2 is a schematic illustration of additional features of an escalator system that may employ various embodiments of the present disclosure.

Turning to FIG. 2, the plurality of sensors 250 may have a respective plurality of sampling elements referenced generally as 260 including first sampling element 260A. The plurality of sensors 250 may also have a respective plurality of sensing elements referenced generally as 270, including first sensing element 270A. The plurality of sampling elements 260 may be respectively disposed on the plurality of sheaves 240. The plurality of sensing elements 270 may be disposed on the first member 210, illustrated schematically in FIG. 2, proximate the respective plurality of sheaves 240. A controller 280, illustrated schematically in FIG. 2, may communicate with the plurality of sensing elements 270.

Figure 3:
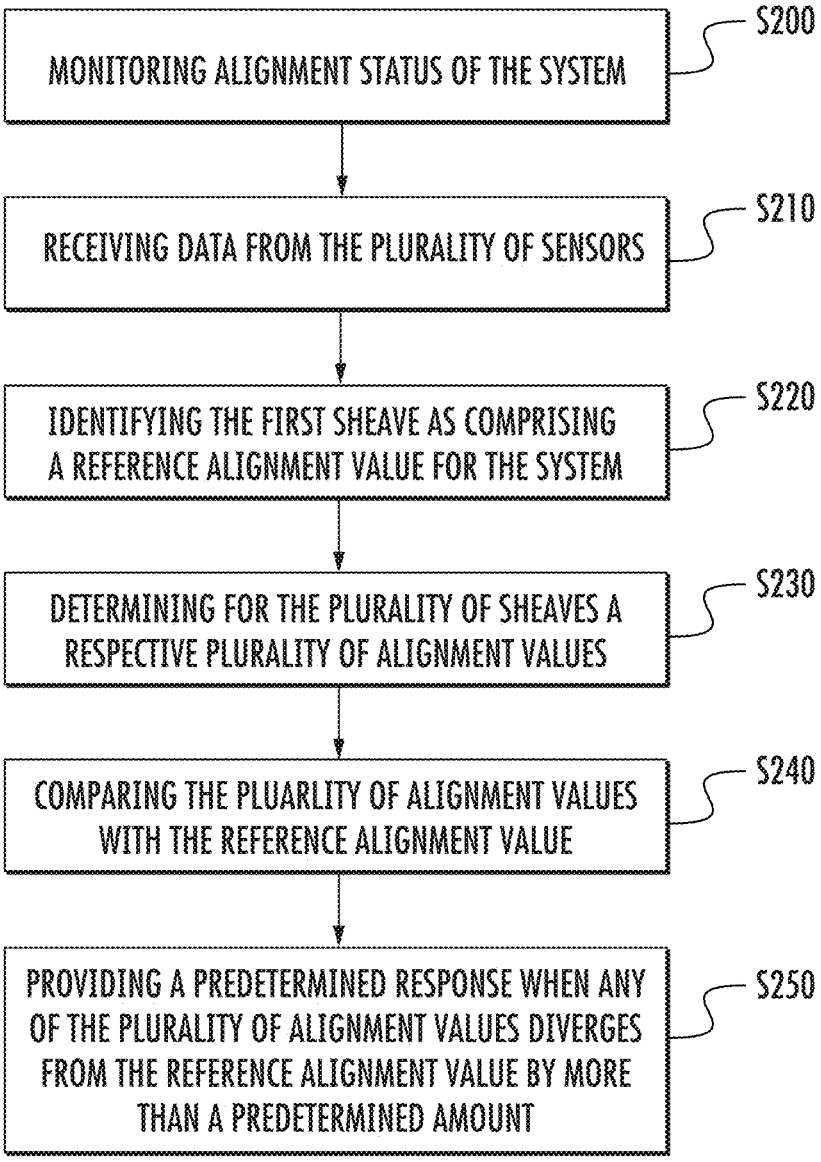
FIG. 3 illustrates a process for utilizing features of a disclosed embodiment.

Turning to FIG. 3, when the first belt 220 is moving from rotation of the plurality of sheaves 240 the controller 280 may perform a process S200 of monitoring alignment status of the system 200. Process S200 may include the controller 280 performing step S210 of receiving data from the plurality of sensors 250. In addition step S220 may include the controller 280 identifying the first sheave 250A as comprising a reference alignment value for the system 200. Under process S200 the controller 280 may also perform step S230 of determining for the plurality of sheaves 240 a respective plurality of alignment values. Further under step S240 the controller 280 may perform the step of comparing the plurality of alignment values with the reference alignment value. Process S200 may further include the controller 280 performing step S250 of providing a predetermined response when any of the plurality of alignment values diverges from the reference alignment value by more than a predetermined amount.

Turning back to FIG. 2, when any of the plurality of alignment values diverges from the reference alignment value by more than a first predetermined amount, a first predetermined response may be transmitting an electronic alert. The alert may be transmitted to a building management system (BMS) 300, for example, over a network 310. According to another embodiment when any of the plurality of alignment values diverges from the reference alignment value by more than a second predetermined amount, a second predetermined response may also be transmitting an electronic alert to the BMS 300. In addition, the second response may include stopping the system 200. The second predetermined amount is greater than the first predetermined amount.

According to an embodiment the plurality of alignment values may comprise a respective plurality of parallel alignment values and angular alignment values for the plurality of sheaves 240. The system 200 may have a desired parallel alignment when, for example, the plurality of sampling elements 260 maintain a fixed distance from the respective plurality of sensing elements 270. The system 200 may have a desired angular alignment when, for example, the plurality of sheaves 240 each have a radially extending axis A that extends in a vertical direction V.

The plurality of sensors 250 may comprise a respective plurality of hall-effect sensors and the plurality of sampling elements 260 may comprise a respective plurality of magnets. The plurality of sheaves 240 may comprise a respective plurality of hubs generally referred to as 320 including first hub 320A. The plurality of sampling elements 240 may be disposed on the respective plurality of hubs 320.

Turning back to FIG. 1, other features of the system 200 are illustrated according to one or more embodiments. The first sheave 240A may comprise a main handrail drive sheave and the plurality of sheaves 240 may further include a tensioner 240B for the main drive sheave 240A, a lower idler sheave 240C and an upper idler sheave 240D. The system 200 may include an escalator brake 330 to effect braking. The escalator brake 330 may be actuated by the controller 280. The first member 210 may be an escalator truss.

As disclosed above, the embodiments provide a first sensor which may be a hall-effect sensor, may be attached to the escalator truss. The first sensor may point to a center of a plurality of escalator components including a plurality of sheaves, such as the handrail main drive sheave and the idler sheave, as well as an idler or tensioner. A magnet may be attached to a center of a sheave hub for a plurality of sheaves and the idler or tensioner. The first sensor may continuously monitor the parallel and angular alignment of the sheave based on the generated magnetic field.

As indicated the first sensor may continuously transmit data to a first controller, which is an escalator controller inside the escalator. Data sent from the main sheave may represent a baseline alignment configuration for the plurality of components. The associated coordinates relative to each side of the handrail may be stored in the first controller. The first controller may continuously monitor the data sent from each sheave. If a difference observed between the main sheave and the other of the plurality of components is greater than a first threshold the first controller indicates determines there is a misalignment and may notify the building management system (BMS). If the difference is greater than a second threshold the first controller may stop the escalator. A level of misalignment and associated responsive actions and alerts are configurable for each region in the controller.

Benefits of the above disclosed embodiments may include reduced manual efforts and downtime, and reduced damage of other drive parts if early detection of misalignment is detected, and relatively better service optimization and service cost reduction.

Figure 4:
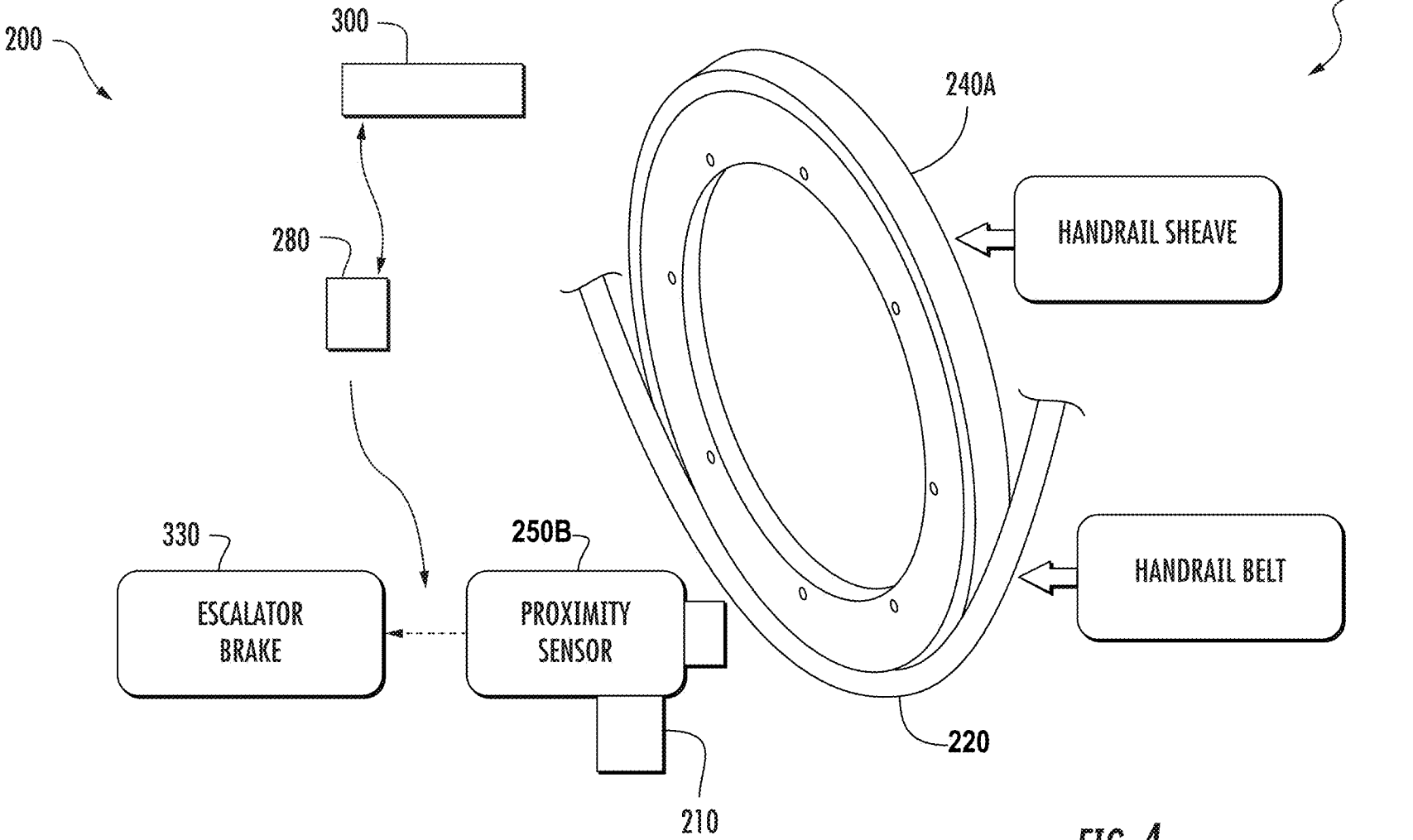
FIG. 4 is a schematic illustration of yet additional features of an escalator system that may employ various embodiments of the present disclosure.

In addition or as an alternative to the above disclosed solutions, turning now to FIG. 4, another configuration of the escalator system 200 is illustrated. Within the system 200, the handrail drive assembly 230 may include a second sensor 250B that may be placed at on the first member, which may be the truss 210 (illustrated schematically). The second sensor 240B may be proximate a distance from one of the sheaves such as the main drive shave 240A, and thereby being a distance from the belt 220. The second sensor 240B may be a different type of sensor than the above sensor 240A or may be a same sensor with additional capabilities of detecting translational movement of the belt 220 relative to the sheave 240A and periodically sending sensed data to controller 280.

The controller 280 may be configured with preset threshold values that enable the controller 280 to determine when the belt 220 has transversely moved relative to the sheave 240A, and is thus potentially slipping off the sheave 240A. The controller 280 may provide warnings and alarms if and when the belt 220 moves transversely relative the drive sheave 240A more than one or more reference values which may be allowed tolerances. The alarm signals may be sent to the BMS 330 and the controller 280 may actuate the escalator brake 330 to effect escalator braking if the displacement value raises more than the predetermined limits.

In one embodiment the plurality of sheaves 240 each include a sensor 250B mounted proximate thereto, each sensor 240B communicating with the controller 280 to determine whether the belt 220 is transversely moving relative to any of the plurality of sheaves 240. Each sensor 240B may be disposed on the truss 210 proximate a respective one of the plurality of sheaves 240 similarly as provided in FIG. 1. This configuration may minimize or prevent damage to the handrail drive assembly 230 due to slippage of the belt 220.

Figure 5:
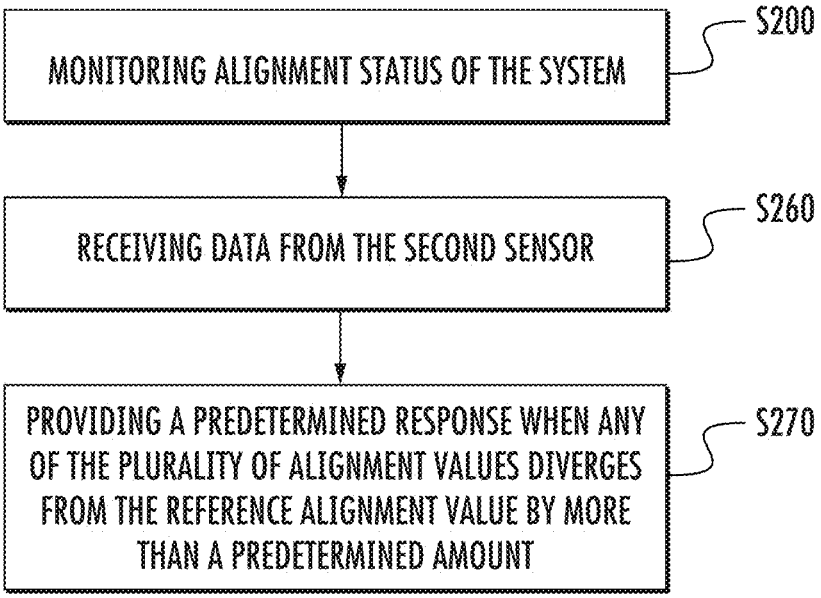
FIG. 5 illustrates an additional process for utilizing features of a disclosed embodiment.

Turning to FIG. 5, when the first belt 220 is moving actuation of the handrail drive assembly 230, such as from rotation of the plurality of sheaves 240, the controller 280 may perform the process S200 of monitoring status of the system 200, as indicated above. Process S200 may further include the controller 280 performing step S260 of receiving data from the second sensor 252, wherein the data is indicative of the transverse position of the belt 220 relative to the sheave 240A. In addition step S270 may include the controller 280 providing a predetermined response when the position of the belt 220 moves transversely relative to the sheave 240A more than one or more reference tolerances, and the predetermined response may include effecting elevator braking and notifying the BMS 330.

With the above disclosed embodiments handrail run may be detected during operation and the escalator may be stopped to prevent or minimized system damage. This may reduce service down time and cost if failure by providing early response to potential malfunctions. This may minimize or prevent handrail wear and tear and increase the useful life of the handrail 220.

As described above, embodiments using a controller can be in the form of processor-implemented processes and devices for practicing those processes, such as a processor. Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes an device for practicing the embodiments. When implemented on a general-purpose microprocessor, the computer program code segments configure the microprocessor to create specific logic circuits.

The term "about" is intended to include the degree of error associated with measurement of the particular quantity and/or manufacturing tolerances based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. An escalator system comprising:

a first member, a first belt, a first assembly operationally connected to the first member and the first belt, the first assembly comprising a plurality of sheaves mounted proximate the first member for driving the first belt, and a plurality of sensors for the plurality of sheaves, the plurality of sensors having a plurality of sampling elements and sensing elements, the plurality of sampling elements being disposed on the respective plurality of sheaves and the plurality of sensing elements being disposed on the first member proximate the respective plurality of sheaves, a controller communicating with the plurality of sensing elements, wherein when the first belt is moving from rotation of the plurality of sheaves the controller:

receives data from the respective plurality of sensors, identifies from the data a first sheave of the plurality of sheaves as comprising a reference alignment value for the system, determines for the plurality of sheaves a respective plurality of alignment values, compares the plurality of alignment values with the reference alignment value, and provides a predetermined response when any of the plurality of alignment values diverges from the reference alignment value by more than a predetermined amount.

2. The system of claim 1 wherein when any of the plurality of alignment values diverges from the reference alignment by more than a first predetermined amount, a first predetermined response is transmitting an electronic alert to a building management system (BMS).

3. The system of claim 2 wherein when any of the plurality of alignment values diverges from the reference alignment by more than a second predetermined amount, a second predetermined response is transmitting an electronic alert to the BMS and stopping the system, wherein the second predetermined amount is greater than the first predetermined amount.

4. The system of claim 1 wherein the plurality of alignment values comprise a respective plurality of parallel alignment values and angular alignment values for the respective plurality of sheaves.

5. The system of claim 1 wherein the plurality of sheaves includes one or more of a main handrail drive sheave, a tensioner for the main handrail drive sheave, a lower idler sheave and an upper idler sheave.

6. The system of claim 5 wherein the first sheave is the main handrail drive sheave.

7. The system of claim 1 wherein the plurality of sensors comprise a respective plurality of hall effect sensors and the plurality of sampling elements are a respective plurality of magnets.

8. The system of claim 1 wherein the plurality of sheaves comprise a respective plurality of hubs, and the plurality of sampling elements are disposed on the respective plurality of hubs.

9. The system of claim 1 comprising an escalator brake operationally controlled by the controller.

10. The system of claim 1 wherein the first belt is a handrail belt, the first assembly is a handrail belt drive assembly, and the first member is a stationary escalator truss.

11. An escalator system comprising:

a first member, a belt, a handrail drive assembly operationally connected to the first member and the belt, the assembly comprising:

a sheave mounted proximate the first member on which the belt is driven, and a sensor mounted to the first member proximate to the sheave, the sensor sensing a relative transverse position of the belt relative to the sheave, a controller communicating with the sensor, wherein when the belt is moving from rotation of the sheave the controller:

receives data from the sensor, determines when the belt moves transversely relative to the sheave, compares the transverse movement with a reference value, provides a predetermined response when the transverse movement diverges from the reference value by more than a predetermined amount.

12. The system of claim 11 wherein when the transverse movement diverges from the reference value by more than the predetermined amount, the predetermined response is transmitting an electronic alert to a building management system (BMS).

13. The system of claim 12 wherein when the transverse movement diverges from the reference value by more than the predetermined amount, the predetermined response is transmitting an electronic alert to the BMS and stopping the system.

14. The system of claim 11 wherein the transverse movement is toward and/or away from the sensor relative to the sheave.

15. The system of claim 11 wherein the sheave is one or more of a main handrail drive sheave, a tensioner for the main handrail drive sheave, a lower idler sheave and an upper idler sheave.

16. The system of claim 15 wherein the sheave is the main handrail drive sheave.

17. The system of claim 11 wherein the sensor comprises a proximity sensor.

18. The system of claim 11 comprising a plurality of sheaves including the sheave, each including a respective sensor mounted proximate thereto, each of the sensors communicating with the controller to determine whether the belt is transversely moving relative to any of the plurality of sheaves.

19. The system of claim 11 comprising an escalator brake operationally controlled by the controller.

20. The system of claim 11 wherein the belt is a handrail belt, the handrail drive assembly is a handrail belt drive assembly, and the first member is a stationary escalator truss.

* * * * *